US007262352B1

(12) United States Patent
Lavorata

(10) Patent No.: US 7,262,352 B1
(45) Date of Patent: Aug. 28, 2007

(54) SUPPORTING SHOULDER REST FOR A STRINGED INSTRUMENT

(76) Inventor: Guido Antonio Lavorata, 4920 E. Colonial Dr., Chandler, AZ (US) 85249-7296

( * ) Notice: Subject to any disclaimer, the term of this patent is extended or adjusted under 35 U.S.C. 154(b) by 0 days.

(21) Appl. No.: 11/517,636

(22) Filed: Sep. 8, 2006

Related U.S. Application Data

(60) Provisional application No. 60/716,061, filed on Sep. 12, 2005.

(51) Int. Cl.
*G10D 1/02* (2006.01)

(52) U.S. Cl. ..... 84/279

(58) Field of Classification Search ..... 84/279–281, 84/290

See application file for complete search history.

(56) References Cited

U.S. PATENT DOCUMENTS 550,721 A 12/1895 Besek
3,827,329 A 8/1974 Annessa
4,884,487 A * 12/1989 Feldkamp ..... 84/280
6,239,337 B1 5/2001 Stein
6,278,044 B1 * 8/2001 Ruan ..... 84/279
2004/0011182 A1 * 1/2004 Ruan ..... 84/278

* cited by examiner

*Primary Examiner*—Kimberly Lockett
(74) *Attorney, Agent, or Firm*—Gregory J. Nelson

(57) ABSTRACT

An improved shoulder rest for a stringed instrument such as a violin or a viola. The rest has a curved edge conforming to the shape of the tail piece of the instrument. One surface of the rest is planar and is positioned against the bottom of the tail piece. The opposite surface has a first region and a second region of increased thickness. An intermediate region transitions between the first and second region. The rest is formed from a resilient foam material and is detachably secured to the instrument by an elastic band extending between the C-bouts and the end button. In a playing position, the thicker second region is placed over the collar bone area of the musician and the thinner first region extends forwardly along the shoulder so as to not raise the instrument.

8 Claims, 3 Drawing Sheets

SUPPORTING SHOULDER REST FOR A STRINGED INSTRUMENT

CROSS REFERENCE TO RELATED APPLICATION

This application is based on U.S. Provisional Patent Application Ser. No. 60/716,061, filed Sep. 12, 2005, entitled Supporting Shoulder Rest for Violins and Violas, and is incorporated herein by reference.

FIELD OF THE INVENTION

The present invention relates to a shoulder rest and more particularly to a shoulder rest for stringed instruments, particularly violins and violas.

Stringed instruments such as violins and violas when properly played are held in a position by the musician with the musician's chin pressing against a chin rest located on the face of the violin. This pressure is transferred and absorbed against the musician's shoulder area and the instrument is supported by the shoulder. The strings are sounded either by drawing the bow across them or by plucking them. The left hand regulates the sounding length of the strings by pressing them against the fingerboard with the fingertips producing different notes. The placement of the left hand on the fingerboard is characterized by positions. For example, in the first position, the first finger is placed on the E strings and gives an F sharp. The upper limit of the violin's range is largely determined by the skill of the player and an accomplished player can play several octaves on a single string and as many as four octaves on the entire instrument.

As pointed out above, it is customary for the violin to be placed beneath the chin resting on the shoulder of the player.

BACKGROUND OF THE INVENTION

Various types of shoulder rests for violins and violas can be found in the prior art. Shoulder rests are used for support and cushioning between the back of the stringed instrument and the player's shoulder while the instrument is being played.

Representative shoulder rests or pads for stringed instruments of the violin and viola type can be found in the following:

U.S. Pat. No. 4,884,487 discloses a chin or shoulder pad for use with violins and violas which includes a soft, flexible, resilient body having gradually rounded sides and a flexible, resilient neck attached to or near one rounded corner of the body and extending diagonally therefrom. The body mounts flush against the underside surface of the resonance body of the musical instrument on a lower end portion thereof below the C-shaped bouts such that the neck extends around and over the chin rest turnbuckle or screw assembly. A pair of straps connect opposite corner portions of a distal end of the neck to corresponding corners at the base of the body to form a pair of loops which extend around lower inside corners of the resonance box bouts. The straps connecting the pad to both bouts tend to inhibit sliding movement of the body and neck caused by rubbing movement of a musician thereagainst. The strap which extends to and around the bout corner located on the side of the resonance box opposite the side containing the chin rest is capable of supporting a decorative ornament which is readily viewable by an observer when the instrument is being played. In the preferred embodiment, the body of the pad is generally rectangular in shape and has rounded sides and the neck is connected to one body corner and extends diagonally outward and upward therefrom.

U.S. Pat. No. 5,507,213 shows a shoulder rest for a violin or viola musical instrument having a support member made of an elastic polyurethane foam material and having opposing surfaces having a multiplicity of regions of depressions and regions of elevations dimensioned and proportioned to permit the regions of elevation to exclusively and compressively bear against the back of the violin such that external forces transmitted to the support member are resiliently transferred through the regions of elevation thereby reducing the bearing surface area against the back of the musical instrument and consequently minimizing the dampening effect the support member has on the sound of the violin or viola. The shoulder rest is removably mounted to the musical instrument by a continuous elastic band carried by the support member and having opposing bights for compressively engaging the lower bout and end peg of the instrument.

U.S. Pat. No. 6,239,337 illustrates a shoulder rest device for a stringed musical instrument, including but not limited to violin and viola. The base pad of the shoulder rest according to the present invention is secured at one end to the chinrest of the instrument by means of two chinrest loops. The other end of the base pad is secured to the back of the instrument by means of a larger, preferably elastic, loop which has a detachable end and which goes over the shoulder junction under the fingerboard and reattaches to the base pad. A pocket part has one lateral side containing hook and loop flaps for inserting foam inserts of various sizes and shapes and a hook and loop strip on the top side to attach it to the base pad at any position.

U.S. Pat. No. 3,827,329 discloses a universal shoulder rest appliance for bowed string musical instruments such as violins and violas. The rest includes a unitary structure mounted on the back of the instrument box and having an elongated arm and a plate connected to the base of the arm. The plate extends beneath the arm and diverges therefrom throughout its length. The base, located at one end of the arm, is provided with a groove and the other end of the arm is provided with a foot having a groove. The groove on the base interfits with the lower ridge of the instrument back beneath the end pin thereon. The intermediate portion of the am between the ends thereof is curved to provide space between the intermediate portion of the arm and the back of the instrument box when the appliance is applied to the instrument. The back surface of the plate is adapted to engage a person's shoulder to rest the instrument thereon. Yieldable means are provided in the grooves at the ends of the arm for connecting the structure to violins and violas of all sizes.

Despite the fact there are numerous and various types of shoulder rests that can be found in the prior art, there nevertheless exists the need for an improved shoulder rest which permits a musician to comfortably hold a stringed instrument such as a violin or viola. The ideal shoulder rest should be light and easy to attach to the instrument. The shoulder rest should accommodate various physical variations of a musician and conform to the individual musician. More importantly, the shoulder rest must be mountable on the instrument in a manner so it will not scratch or otherwise damage the instrument.

BRIEF SUMMARY OF THE INVENTION

Briefly, the present invention provides an improved shoulder rest for stringed musical instruments which rest is molded or otherwise formed or shaped from a resilient material such as expanded polymer foam with cross linked polyethylenes and urethanes being acceptable materials. The rest has a somewhat semi-circular configuration which generally conforms to the shape of the tail piece of the instrument. The surface of the rest which engages the instrument is generally planar and the surface which engages the shoulder of the musician is contoured extending parallel to the bottom surface partway along its width in a first region. The thickness of the rest in the first region is selected to provide comfort without raising the instrument excessively. At an intermediate location, the surface transitions upwardly to a thicker second region. The thicker region in the playing position is positioned over the collar bone and assists in holding the instrument in a proper position over the shoulder. The rest is detachably securable to the instrument by an elastic band which is attached to the end button of the instrument and stretched across the bottom points of the C-bouts on the back of the instrument.

The rest is slipped beneath the elastic band with the curved side of the rest aligned with the curved end of the tail piece. The thicker part of the rest is placed so it is positioned over the musician's collar bone.

In one embodiment, the rest may be a laminate structure in which a more rigid material is laminated to the planar surface to provide additional stability and inhibit movement of the shoulder rest during performance. In another embodiment, the rest may be entirely formed from a single type of resilient foam.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 5:
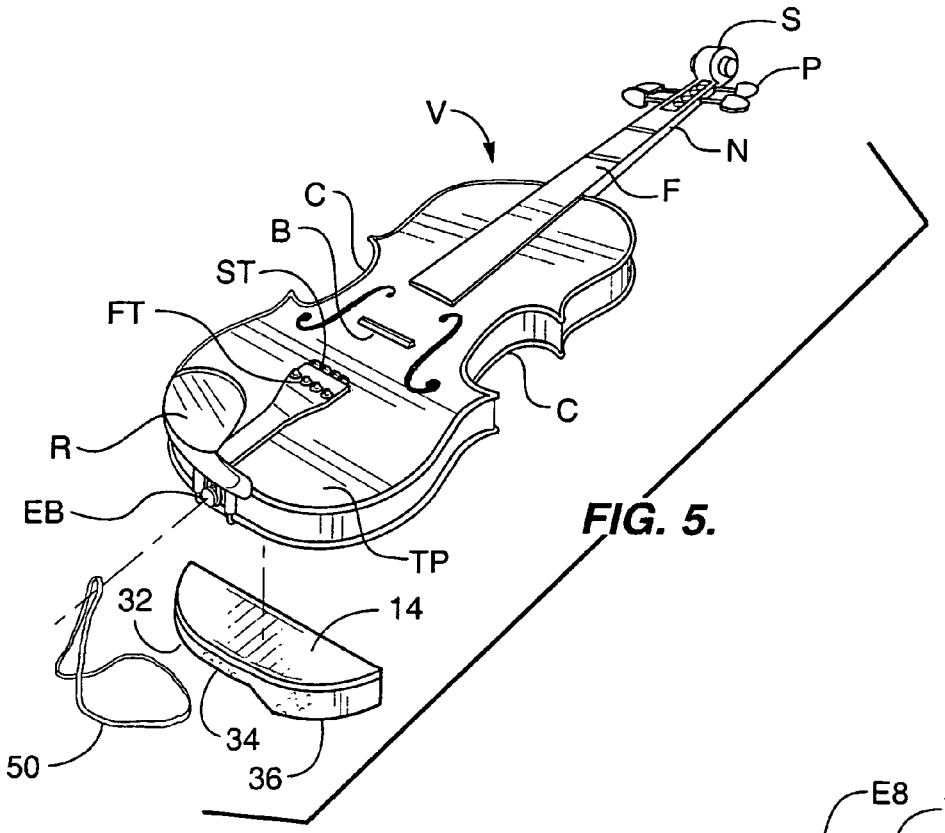
FIG. 5 is a perspective view showing a representative stringed instrument such as a violin or viola and showing the shoulder rest and elastic band, as shown in FIG. 2, in a position prior to attachment.

Turning now to the drawings, FIG. 5 illustrates a representative instrument such as a violin or a viola indicated by the letter V. To facilitate an understanding of the present invention, a description of the components of the instrument is believed helpful. The stringed instrument V has a neck N with a fingerboard F. The distal end of the neck terminates at a scroll S with tuning pegs P extending from the area in the neck adjacent the scroll. The instrument has a body with C-bouts C on opposite sides of the body. A bridge B supports the strings ST which terminate at fine tuners FT. The tail piece TP of the instrument is curved and the upper surface carries a chin rest R. An end button EB is located on the edge of the tail piece TP.

Figure 1:
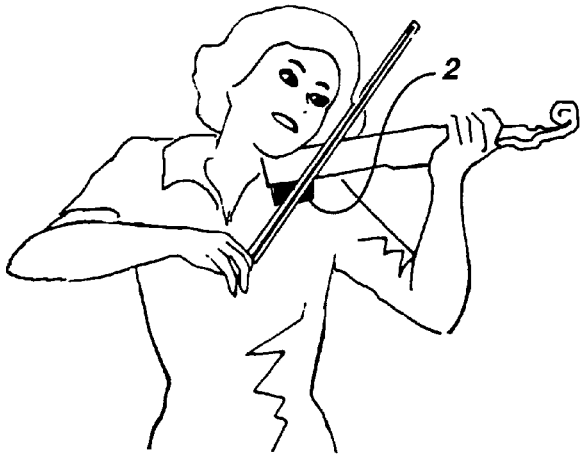
FIG. 1 illustrates a musician playing a stringed instrument such as a viola with the rest of the present invention interposed between the players' shoulder blade and the underside of the instrument.
Figure 2:
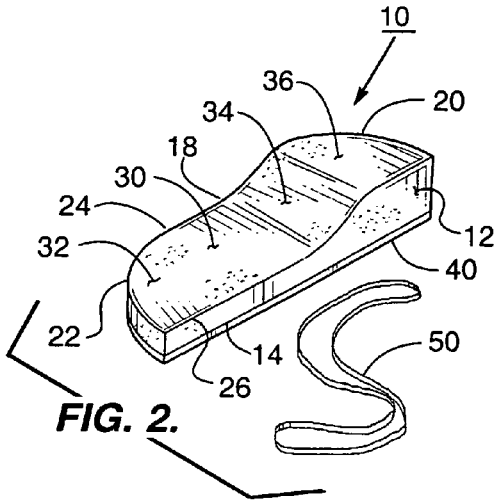
FIG. 2 is a perspective view showing one embodiment of the rest of the present invention and the elastic attachment band.

Referring to FIG. 2, one embodiment of the rest of the present invention is shown and is designated by the numeral 10. The rest 10 has a body 12 with a generally planar or flat surface 14. In use, the planar surface 14 is disposed against the bottom side of the tail piece. The body 12 is preferably formed by molding or is cut or otherwise formed from a suitable, resilient material such as an expanded polymeric or rubber foam. The foam may be a material such as polyurethane or polyethylene and is of a density which is durable, comfortable and will not unduly compress while the instrument is being played so as to not interfere with the stability of the instrument. The material designated 140-70 polyurethane ether foam has been found to be a suitable material. The material selected should not be abrasive, nor should it chemically react with the lacquer finish of the instrument.

Figure 3:
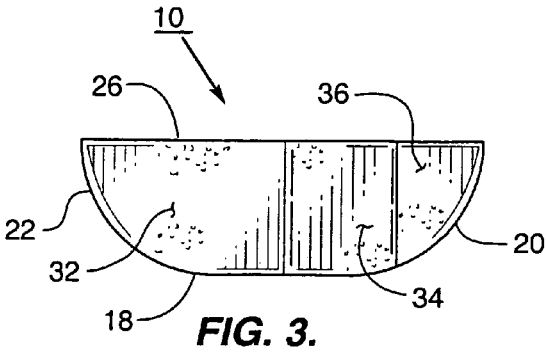
FIG. 3 is a top view representative of the rest shown in FIGS. 2 and 2A.
Figure 4:
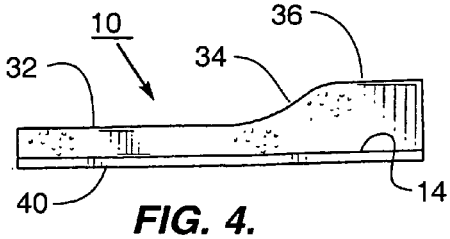
FIG. 4 is a side view of the shoulder rest as shown in FIG. 2.

The body of the rest has a rear edge 18 which is generally curved and somewhat semi-circular having arcuate end sections 20 and 22 and a generally flat intermediate section 24 joining the arcuate end sections. The opposite edge 26 is generally flat and, as seen in FIG. 3, the overall configuration formed by arcuate ends 20, 22 and intermediate section 24 conforms generally to the shape of the tail end of the instrument. This configuration provides the user a visual guide when attaching the rest to an instrument as the edge 18 is aligned with the curved end of the tail piece TP. While the dimensions may vary somewhat, it is preferred the overall width be approximately 7" to 8" and the radius of curvature of the arcuate sections 20, 22 is approximately between 2" and 3".

The upper surface 30, which is disposed against the musician's shoulder and neck, defines three regions including a first region 32, an intermediate transition region 34 and a second region 36. The first region 32 is generally planar and transitions at curved or arcuate intermediate region 34 to a thicker second region 36 which also has a generally planar surface. The thickness of the first region 32 is generally approximately ½" to 1" in thickness. The thickness or depth of the second region 36 is approximately between 1¼" to 2". Transition region 34 gently contours or extends at an angle between the first region 32 and the thicker second region 36.

A substrate 40 is laminated to planar surface 24. Preferably the laminate material is a cross linked material having a density greater than that of the body 12 of the rest. The laminated substrate can be glued or otherwise bonded to the planar surface 14 to provide additional stability. Typically, the thickness of the laminated substrate 40 is relatively thin being less than ¼" in thickness. The substrate 40 provides rigidity and inhibits movement of the rest during performance and the surface of the material is sufficiently smooth so that it will not damage the lacquered surface of the instrument.

Figure 2A:
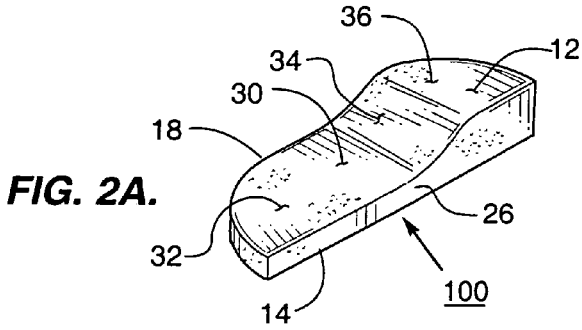
FIG. 2A is a view similar to FIG. 2 showing an alternate embodiment of the rest of the present invention.

The embodiment of the rest 100, as shown in FIG. 2A, is similar to that shown in FIG. 2 with the exception that the rest 100 does not include a laminated substrate on the bottom surface. While the incorporation of the laminated substrate increases stability, it may not be necessary in all uses and, in some cases, the musician may prefer a resilient rest which does not include the substrate 40. In other respects, the rest 100 is as has been described with reference to FIG. 2 having the same configuration and contour having a rear edge 18, flat edge 26 and opposite surfaces 14 and 30. Surface 30 defines regions 32, 34 and 36.

The shoulder rest, as shown in FIGS. 2 and 2A, is removably secured to the instrument by an elastic band 50 which is shown in FIG. 2. The band 50 may be any suitable elastic material, preferably non-latex, such as a stretchable plastic or a natural or synthetic rubber. The band 50 is formed in a continuous loop as shown. The manner of attaching the rest to the instrument V will described below with reference to FIGS. 5 to 7.

Figure 6:
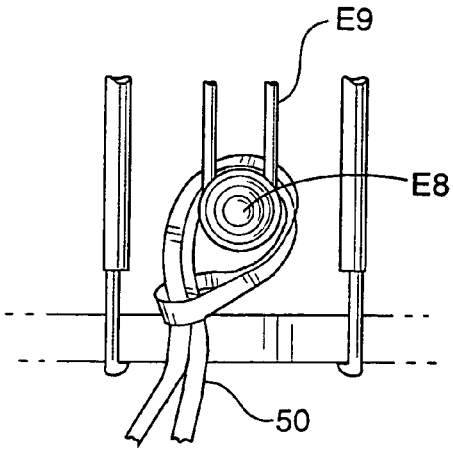
FIG. 6 illustrates the manner of attachment of the elastic band to the end gut of the instrument.
Figure 7:
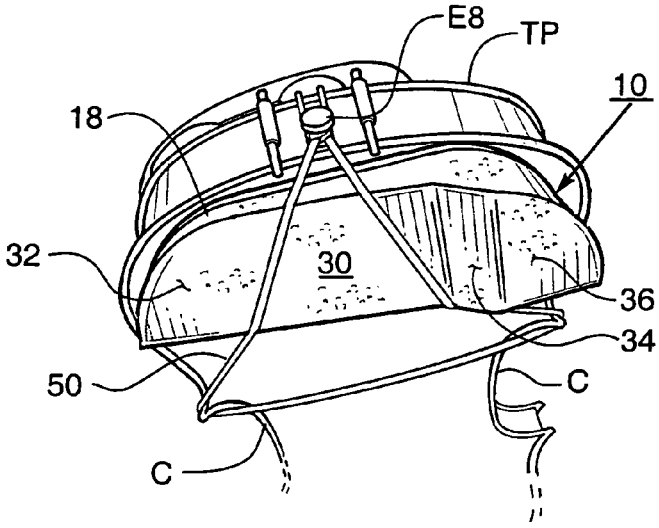
FIG. 7 is a perspective end view showing the rest and elastic attachment band secured to the underside of the instrument.

Referring to FIG. 5 which is an exploded, perspective view showing the rest 10 of FIG. 2 disposed in a position below the tail piece of the instrument prior to installation and to FIGS. 6 and 7. It is understood that the following description also applies to the embodiment 100 of the rest shown in FIG. 2A. An elastic band 50 is shown adjacent the end gut EG which wraps around the end button EB. The flat surface 14 of the shoulder rest, as shown in FIGS. 2 and 2A, is positioned facing the bottom of the body of the instrument. The elastic band 50 is slipped beneath the end gut EG of the instrument. One end of the elastic band is placed into the eye of the other and pulled so that it tightens around the end button EB as shown in FIG. 6. The elastic band now has the appearance of a small noose. The elastic band is stretched and attached to the bottom points of the C-bouts on the back of the instrument as shown in FIG. 7. The elastic band 50 is now installed and the shoulder rest 10 may be slipped beneath the elastic band with the flat or planar backside disposed against the surface of the instrument.

The curved surface rear edge 18 of the rest is aligned with the curved surface of the instrument and the rest positioned so that the thicker second region 36 of the rest is in a position to be placed over the collar bone of the musician. The instrument is now ready to be placed in a position with the rest resting on the collar bone of the musician. The thicker region of the resilient rest aids in supporting the instrument correctly over the left shoulder. The region 32 extends forwardly and due to its thinner cross-section will not raise the instrument too high into the musician's neck. If a rest, as shown in FIG. 2, is installed, the laminated substrate 14 will aid in preventing the shoulder rest from shifting during performance. The density of the foam is durable, yet comfortable and the overall design has a low profile which provides comfort without raising the instrument excessively high into the neck of the musician.

When the musician is finished playing, the elastic band and shoulder rest can quickly be removed and the size of the components allow it to be conveniently stored in the instrument case ready for reattachment.

Figure 8:
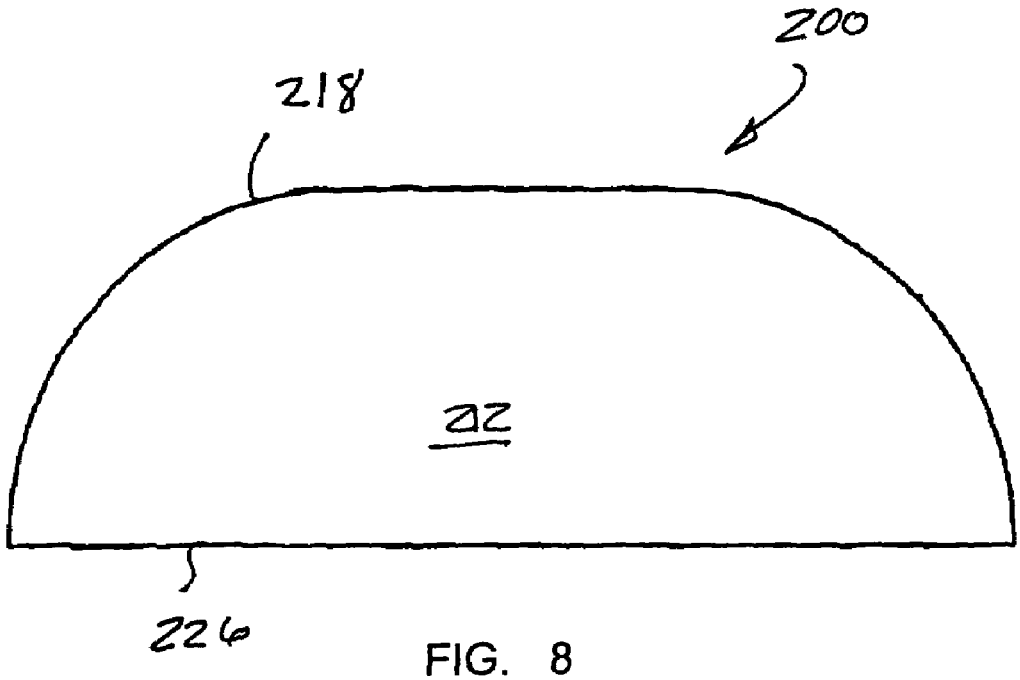
FIG. 8 is a top view of another embodiment of the rest of the present invention.
Figure 9:
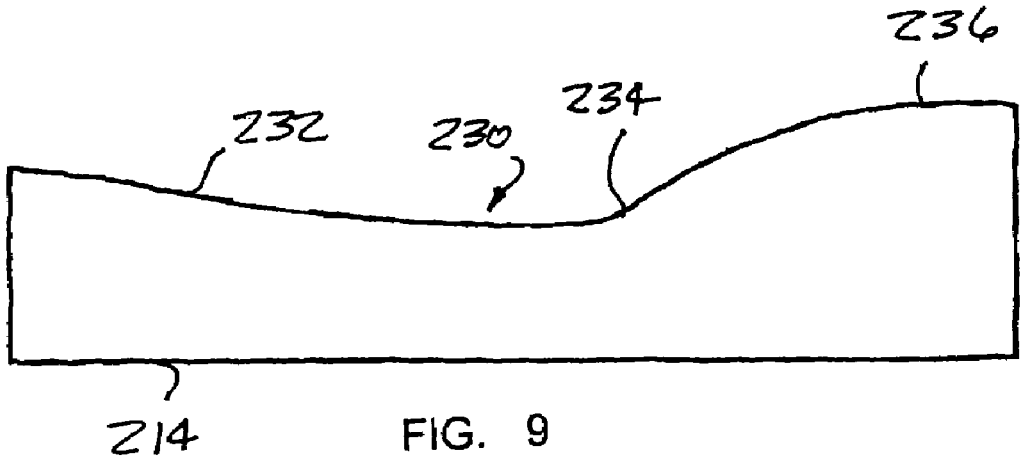
FIG. 9 is a front view of the rest shown in FIG. 8.

FIGS. 8 and 9 illustrate another embodiment of the rest of the present invention generally designated by the numeral 200 having a body 212 with generally planar surface 214. The body 212 may be a foam material as described or may be a foam such as an open cell polyester foam which is odorless, breathable and resistant to bacteria. The material designated R600U has been found acceptable. The body has rear edge 218 which is curved and opposite flat edge 226 so the shape conforms to the shape of the tail end of the instrument.

The surface 230 is disposed against the musician's shoulder and neck and defines region 232, intermediate region 234 and region 236. Region 232 is slightly downwardly tapered or is inclined toward intermediate transition region 234 which curves upwardly to region 236. Region 236 may be planar or regions 234 and 236 may define a continuous curve or contour. Region 236 is thicker having a greater depth than region 234.

The embodiment 200 minimizes any difficulty a musician may have in properly placing the rest on the player's shoulder. The musician simply aligns the curve 218 with the curve of the lower bout of the instrument. Thus, placing the thicker region 236 over the collarbone aiding in the proper elevation of the instrument over the left shoulder for correct posture.

The embodiment of the rest shown in FIGS. 8 and 9 is attached to the instrument using a band such as band 50 as previously described.

A unique feature of the invention is that the rest will accommodate various size instrument such as ½-¾ violins and 12-16 violas. Various sizes of the rest can be provided to accommodate a range of players from young students to adults.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A shoulder rest securable to the tailpiece of a stringed musical instrument having a body which when played is held between the player's chin and shoulder, said rest comprising:

(a) a body having a first surface, a rear edge, a front edge, first and second opposite ends and a second opposite surface, said body being a resilient material;

(b) said first surface being generally planar, said rear edge being curved generally conforming to the shape of the tailpiece of the musical instrument, said second surface having a first region, an intermediate region and a second region, said first region being generally planar and having a first thickness and extending from said first end to said intermediate region, said second region being generally planar having a second thickness greater than said first thickness and extending from said second end to said intermediate region, and said intermediate region providing a transition between said first and second regions; and (c) retaining means for detachably securing said rest to said instrument with the first region disposed over the shoulder and the second region disposed over the collar bone of the player to maintain the instrument in a comfortable, generally horizontal playing position.

2. The shoulder rest of claim 1 wherein said resilient material is selected from the group consisting of polyurethane, polyethylene and polyester.

3. The shoulder rest of claim 1 wherein the body is a resilient material having a first density and further including a substrate extending across said first surface of a material having a second density which is greater than said first density.

4. The shoulder rest of claim 1 wherein said resilient material is a foam.

5. The shoulder rest of claim 1 wherein the said retaining means comprises an elastic band detachably securable to said instrument.

6. The shoulder rest of claim 1 wherein said first regions taper downwardly.

7. A shoulder Test for a stringed musical instrument having a body with a tail piece having a curved rear edge and a top and bottom surface, said instrument when played held with the player's chin against said top surface and with said bottom surface disposed against the collar bone of the player and said rest securable in a use position to the bottom surface between the chin and collar bone, said rest comprising:

(a) a body of a resilient material having a first generally flat surface, an opposite second surface, a rear edge, a front edge and opposite ends;

(b) said rear edge being generally curved conforming to the shape of said curved, rear edge of the tail piece;

(c) said second surface having a first region adjacent one end of the body, a second region adjacent the opposite end of the body and an intermediate region, said first region having a first thickness and said second region having a second thickness which is greater than said first thickness, said intermediate region providing a transition between said first and second regions; and (d) an elastic band detachably securable to said instrument detachably securing said rest to said instrument in a position with the second region disposed over the collar bone of the player and with the rear edge aligned with the tailpiece to maintain the instrument in a proper playing position.

8. The shoulder rest of claim 7 wherein said first region tapers downwardly toward said intermediate region.

* * * * *